US011465899B2

(12) United States Patent
Wells

(10) Patent No.: US 11,465,899 B2
(45) Date of Patent: Oct. 11, 2022

(54) FUEL CADDY WITH HAND CRANK FOR PUMP LOCATED ON THE NOZZLE

(71) Applicant: Shay Aaron Wells, Newcastle, OK (US)

(72) Inventor: Shay Aaron Wells, Newcastle, OK (US)

( * ) Notice: Subject to any disclaimer, the term of this patent is extended or adjusted under 35 U.S.C. 154(b) by 87 days.

(21) Appl. No.: 17/081,069

(22) Filed: Oct. 27, 2020

(65) Prior Publication Data

US 2022/0127131 A1 Apr. 28, 2022

(51) Int. Cl.
*B67D 7/60* (2010.01)
*B67D 7/84* (2010.01)
*B67D 7/04* (2010.01)

(52) U.S. Cl.
CPC ..... *B67D 7/60* (2013.01); *B67D 7/04* (2013.01); *B67D 7/845* (2013.01)

(58) Field of Classification Search
CPC ..... B67D 7/845; B67D 7/645; B67D 7/60; B67D 7/04; B05B 11/3056; F04B 9/14
See application file for complete search history.

(56) References Cited

U.S. PATENT DOCUMENTS 1,191,855 A * 7/1916 Tuszka ..... G05G 1/085 16/361
5,667,113 A * 9/1997 Clarke ..... B67D 7/845 222/530
6,834,670 B2 * 12/2004 Rosine ..... B65H 75/22 137/355.27
7,017,603 B1 * 3/2006 Rosine ..... B65H 75/4471 242/395.1
7,163,034 B2 * 1/2007 Franks ..... B67D 7/0205 222/383.2
7,293,587 B1 * 11/2007 Broberg ..... A63H 17/00 141/98
7,422,039 B2 * 9/2008 Chisholm ..... B67D 7/04 239/525
7,549,847 B1 * 6/2009 McClatchey ..... F04B 9/02 417/15
7,575,188 B2 * 8/2009 Mullen ..... B65H 75/4471 242/588.2
7,814,941 B2 * 10/2010 Alex ..... B67D 7/42 141/26
8,201,588 B2 * 6/2012 Bonner ..... B67D 7/048 141/59

(Continued)

OTHER PUBLICATIONS

Liquidynamics—All Categories https://liquidynamics.com/category (Year: 2015).*

(Continued)

*Primary Examiner* — Timothy L Maust
(74) *Attorney, Agent, or Firm* — Donald Debelak

(57) ABSTRACT

The invention broadly comprises a portable device (fuel caddy) for transferring fluids, particular for transferring gasoline from a storage container to gasoline using vehicles, boats or equipment. The device includes an external housing with an inlet and a discharge through a nozzle with a pump located on the external housing, with the pump operated by a hand crank located on the nozzle. The external housing includes all-terrain wheels, a tow loop for use on ATVs' and trucks, and an extended hose to the nozzle.

3 Claims, 8 Drawing Sheets

(56) References Cited

U.S. PATENT DOCUMENTS

| | | | | |
|---|---|---|---|---|
| 8,844,402 | B2 * | 9/2014 | Ulmann | G05G 1/085 74/547 |
| 11,029,022 | B2 * | 6/2021 | Berard | F23D 14/38 |
| 2003/0190240 | A1 * | 10/2003 | Liao | F04B 9/127 417/395 |
| 2006/0255069 | A1 * | 11/2006 | Bonner | B67D 7/845 222/207 |
| 2013/0168420 | A1 * | 7/2013 | Kern | B67D 7/845 222/401 |
| 2018/0334377 | A1 * | 11/2018 | Hart | B62B 3/104 |

OTHER PUBLICATIONS

DuraMax Flow n' Glow Wheeled Fuel Transport, literature submitted electronically with this form, from Scepter Marine, Division of Myers Industry, Wilmington, Delaware.

Suncoo Portable Gas Caddy Fuel Storage Tank on Wheels, literature submitted electronically with this form, from www.wsuncoo.com.

Flo-Fast Gas Container with Pump and Cart, literature submitted electronically with this form, fromwww.flofast.com, Flo-Fast 17060 South Shore Lane, Eden Prairie, MN.

* cited by examiner

FUEL CADDY WITH HAND CRANK FOR PUMP LOCATED ON THE NOZZLE

FIELD OF INVENTION

The invention relates generally to a portable device for transfer pumps. In particular, the invention relates to a portable transfer pump for transferring fuels, having an in-line motor and an ergonomic shape.

BACKGROUND

Equipment needing fueling that is not convenient cannot be brought to a standard gas station calls for either carrying portable gas tanks to the vehicle or machinery in need of fuel which is often done with a fuel caddy, which is a large tank, on wheels with a delivery nozzle. The market has a need to have a method of fueling remote or stranded vehicles, industrial machinery, and farm equipment. The other major issue is that gas stations at out of the way locations tend to charge very high prices, making a fuel caddy an attractive alternative even when gas stations are available.

Most products on the market today pump air into the fuel storage container to push the gas out, which requires a two person operation in most fueling operations, and these products have problems with leakage and spillage.

SUNCOO's 30 Gallon Portable Gas Caddy Fuel Storage Tank on Wheels for gasoline or diesel has a two way, hand cranked rotary pump. This product does not have a nozzle, a hand crank operates a two-way pump that pumps fuel out the fuel caddy into a tube, the fuel then goes out the tube into a funnel and then into the equipment needing fueling. This product's two way pump can also remove fuel remaining in vehicles or machinery fuel storage compartments when those vehicles or machinery won't be used for an extended period. The product's big drawback is that it needs two people to operate when the caddy's fuel storage container can't be brought right up to the vehicle, boat, farm equipment or industrial equipment. When the fuel caddy's storage can't be brought close to the equipment being fueled fuel intake location, the operator can't operate the pump and the nozzle at the same time.

Scepter Marine's DuraMax Flo offers a fuel caddy which offers a hand pump and a 10 feet foot hose. It does not have a nozzle and if the equipment being fueled is not right next to the caddy, the fuel caddy requires a two person operation.

Northern's Flo Fast Gas Container with Pump and Cart, has a 15 gallon tank, with a rotary pump capable of pumping eight gallons per minute, that pumps into a hose. This product does not have a nozzle and comes with a five foot hose.

Other products on the market are similar; they require a two person operation unless the fuel caddy can be brought next to the equipment being fueled. And without a drip free nozzle, every fuel caddies' fueling operation runs the risk of leaks or spills which is a major safety issue.

Three main product types are on the market today. Current liquid fuel caddies use gravity, hand pump nozzles and drum pumps to dispense the liquid fuel from the container. When using gravity to feed the fuel from the container to the nozzle, the height of the fuel container needs to be higher than the height of the nozzle. Using a hand pump nozzle similar to what is shown in U.S. Pat. No. D516,673 to Chisholm & Alex (2006) will allow for the nozzle height to be higher than the fuel container and also allow the operator to be as far away from the fuel container as the hose length and pump capacity allow. Squeezing the hand pump nozzle of a gravity driven fuel caddy can be strenuous, especially when dispensing large volumes of fuel. Drum pumps can dispense large volumes of fuel without strenuous activity or concern about the height of the dispensing nozzle to fuel container of the equipment being fueled, but the operator of current systems has to be at the fuel container actuating the drum pump. It is not safe for one operator to be at the liquid fuel caddy fuel container when dispensing fuel because the container/tank being filled can overflow and spill on equipment or ground causing slip hazards or risk of fuel combustion. As a result current drum pump products need two people to operate safely, one at the liquid fuel cavity fuel container and the other at the container/tank being filled.

Another system on the market use an integral lever air pump that draws in air from the atmosphere via a vacuum produced from a retracting piston. The air in the piston is then pressed into the fuel container when the piston is advanced by a hand lever. The compressed air is stored energy inside the fuel container provides pressure to push the liquid fuel through the hose when the nozzle valve is released. This method of fuel dispensing requires extra pressure on the tank which can be dangerous and also doesn't work well when the fuel caddy is running low on fuel, which leaves too much fuel in the caddy when it should be empty. This also creates flow problems, as flow from the caddy varies depending on the inside air pressure.

The market has an unmet need for a fuel caddy with one person operation. It also requires a better dispensing system to minimize or eliminate spills and leaks while fueling. Fuel caddies work best with drum rotary pumps as they supply steady pressure, and can more effectively empty the tank of the fuel caddy. The other major issue with fuel caddies is that they need to offloaded from a truck or other vehicle, fueled at a the gas station or other fuel source, then put back on the truck or vehicle and transported to a site near where the fuel caddy's fuel is needed. This series of events can cause issues if there is not a firm shut off point, such as a nozzle, and a locking position for the nozzle on the fuel caddy during transport.

SUMMARY OF THE INVENTION

The basic function of this invention is to bring a hand cranked pump to the nozzle to allow one person dispensing. The key features of the invention are: 1) placing the hand crank right behind the nozzle; 2) having the fuel caddy's storage tank positioned so it can be loading lying flat with a gas cap on the one side of the fuel storage compartment, and 3) using a three hook system to allow the caddy hose to be safely stored; rather than using a one hook system that allows the hose to move around excessively. The fuel caddy can have a main body that holds 15, 30, 35 or 60 gallons of fuel as well as other sizes. The main advantages of the invention are.

- creating a safer environment to those dispensing fuel because they are at the point of dispensing, ensuring fuel from the nozzle goes into the fuel tank of fuel receiving equipment; eliminating the need to shift back and forth from the fueling point to the fuel caddy's fuel container;
- simplifying filling the fuel caddy's liquid fuel container at the re-fueling station; better and tighter (less space taken) storing for the fuel caddy hose;
- a foldable feature of the hand crank which allows the unit to be stored in as small a space as possible.

PART NUMBER DESCRIPTION

1. fuel dispense nozzle
2. gas flow control mechanism

3. gas flow control lever
4. gas hose
5. rotary pump
6. handle to operate crank
7. crank to operate pump
8. swivel connection for gas hose.
9. gas hose connection
10. metal gas hose connection port on the fuel caddy
11. gas hose connection that connects to 10
12. swivel on the gas hose that connects to fuel caddy.
13. side grips, which are part of the mold of the gas caddy.
14. off road tires
15. gas cap for filing fuel caddy.
16. top hook positions, for two hooks, for gas hose to hang up.
17. lower hook position, creating a triangle effect for the hooks, the hose to hang up.
18. back hook, allows the fuel caddy to attach to a ladder and also helps to keeps the fuel caddy level when lying horizontally.
19. adding a hand grip to the bottom of the mold for lifting.
20. towing attachment.
21. integrated gas flow control mechanism and rotary pump with handle.
22. connector on rotary pump to connect with the gas flow control mechanism.
23. connector on the gas flow control mechanism to connect with the rotary pump.
24. hinges for the towing attachment.
25. support bars for the towing attachment, connecting the towing attachment to the hinges.
26. quick snap holder for the towing attachment.

DETAILED DESCRIPTION

Figure 1:
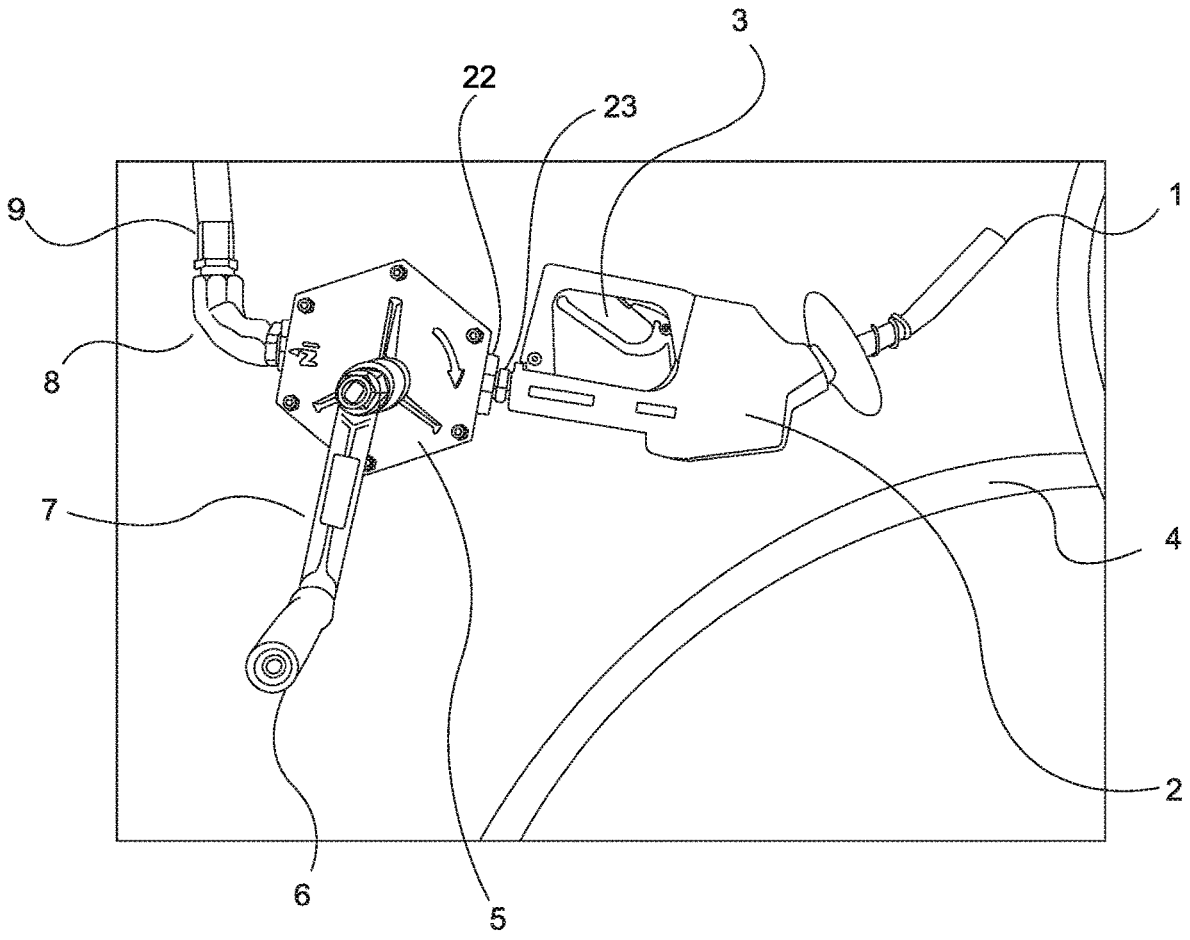
FIG. 1 shows the nozzle, location of the hand crank and rotary drum. The hand crank folds over the rotary drum when not in use.

FIG. 1 illustrates the fueling components of the fuel caddy as it ready to fuel. The fuel dispensing nozzle 1 goes into the vehicle, ATV, boat or machinery, being fueled, the nozzle is an integral part of the gas flow control device 2, which has a cutout section where the gas flow control lever 3 fits. The gas flow control mechanical device 2 connects to the rotary pump 5, which is operated by the hand crank 6 which also has a foldable part 7 that allows the handle to fold over the rotary pump 5 when not in use. The gas hose 4, is quite long as it leaves the rotary pump 5 going back to the fuel caddy. The gas hose 4 is a flexible tube that can work its way through or over obstructions. The gas hose has a swivel connector 8 to allow the gas hose 4 to rotate, and it is connected to the gas hose through connector 9 which sits on the gas hose 4.

Figure 2:
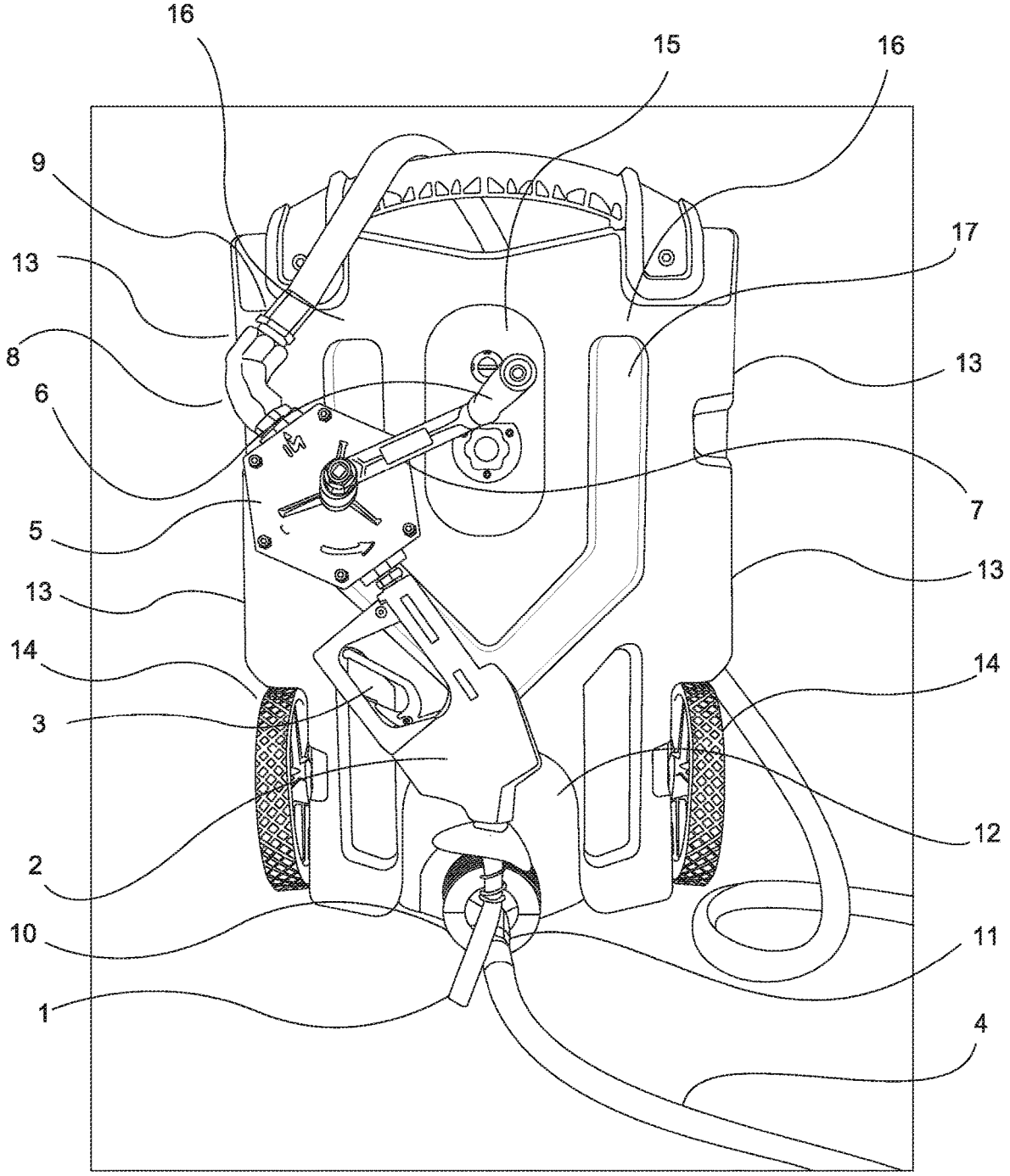
FIG. 2 shows the front of the fuel caddy with the fuel caddy not in use.

FIG. 2 illustrates the front of the fuel caddy when it is not in use. The second end of the gas hose 4 has a connector 11 which is attached to a swivel 12 and connected to the metal connection port on fuel caddy 10. The molded body of the fuel caddy has two handles 13 molded in, one higher than the other on each side of the fuel caddy, two hooks near the top of the fuel caddy 16 and a hook further down on the left side 17, are there to wind up the gas hose 4 when the fuel caddy is not use. The figure also shows how the swivel connection 8, which is attached to the rotary pump 5 connects to the gas hose connector 9. The gas flow control mechanical device 2 with the gas nozzle 1, gas flow control lever 3 are shown draped into position, based on the extra hose that isn't wrapped around hooks 16 or 17. Another notable feature in FIG. 2 is the off-road tires 14.

Figure 3:
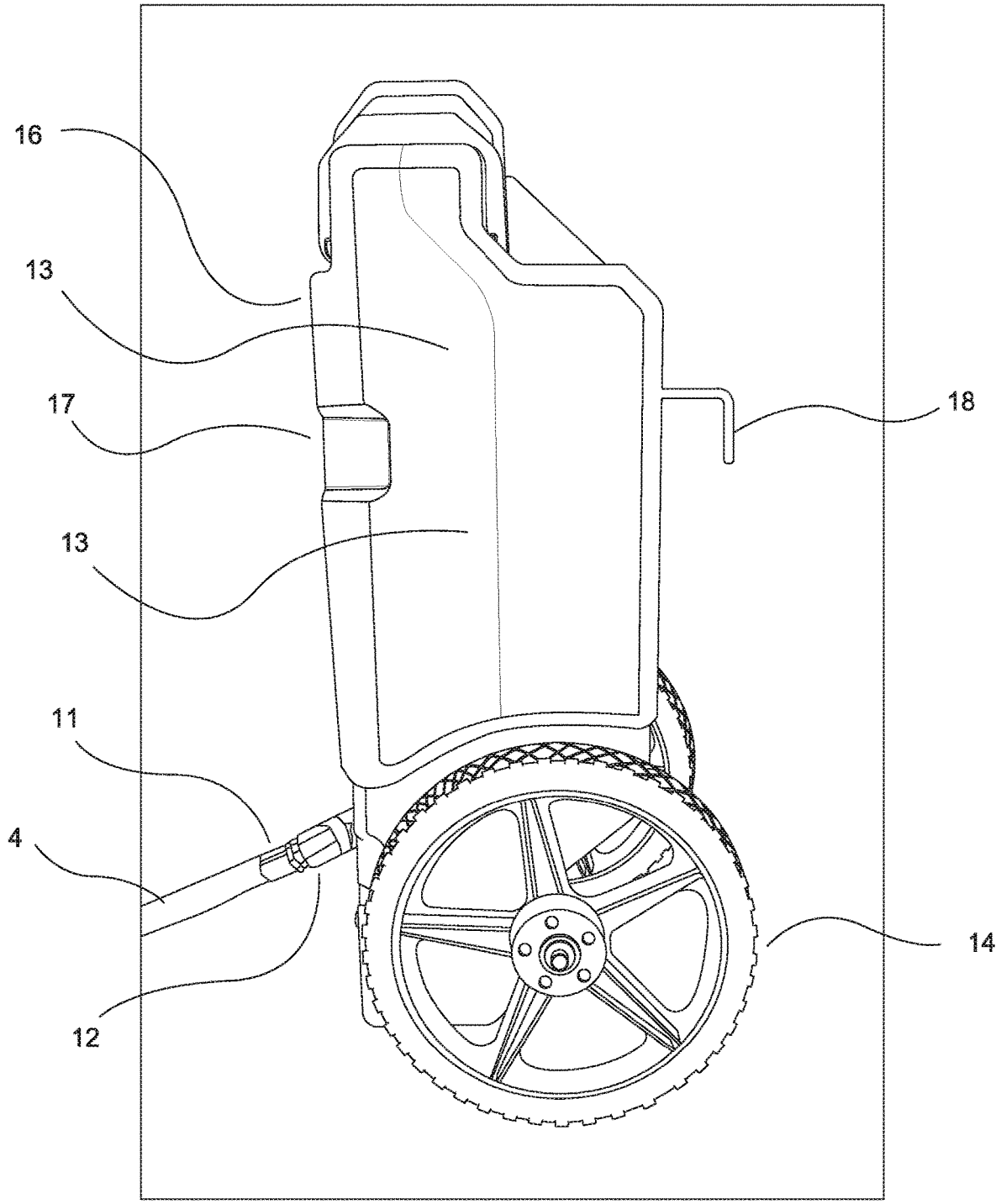
FIG. 3 shows a side view of the fuel caddy with the hose coming out of the connector on the lower front.

FIG. 3 illustrates the side view of the fuel caddy, showing the bottom connection the gas hose 4, showing the second swivel connected to the fuel caddy and the gas hose connection 11. Also shown are the location of the two molded in handles 13, the off-road wheels 14, the one hook location 16 for winding the gas hose 4, and the back hook 18.

Figure 4:
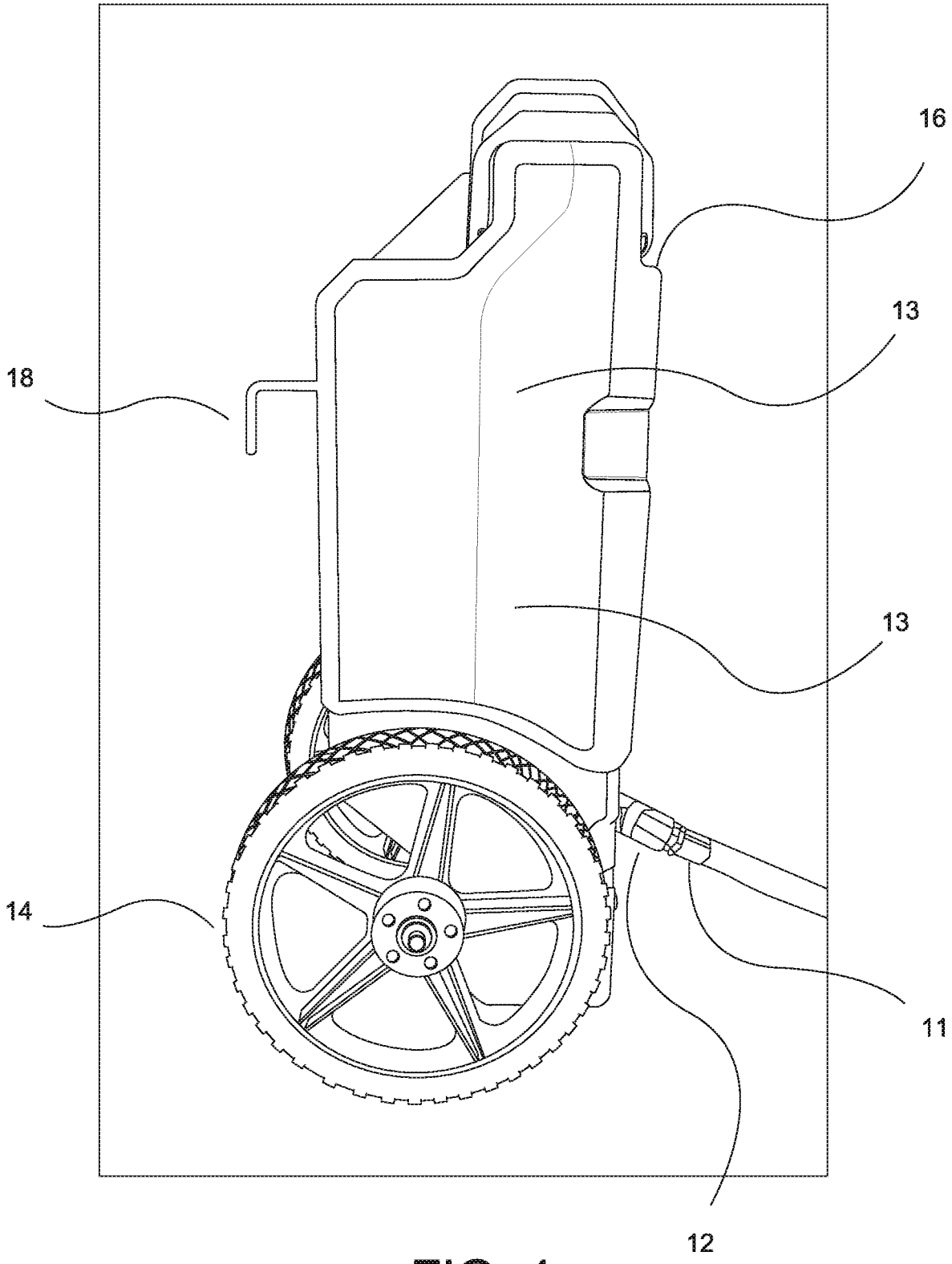
FIG. 4 shows the side view of the fuel caddy.

FIG. 4 illustrates the opposite side view of the fuel caddy showing the bottom connection the gas hose 4, showing the second swivel connected to the fuel caddy and the gas hose connection 11. Also shown are the location of the two molded in handles 13, the off-road wheels 14, the one hook location 16 for winding the gas hose 4, and the back hook 18.

Figure 5:
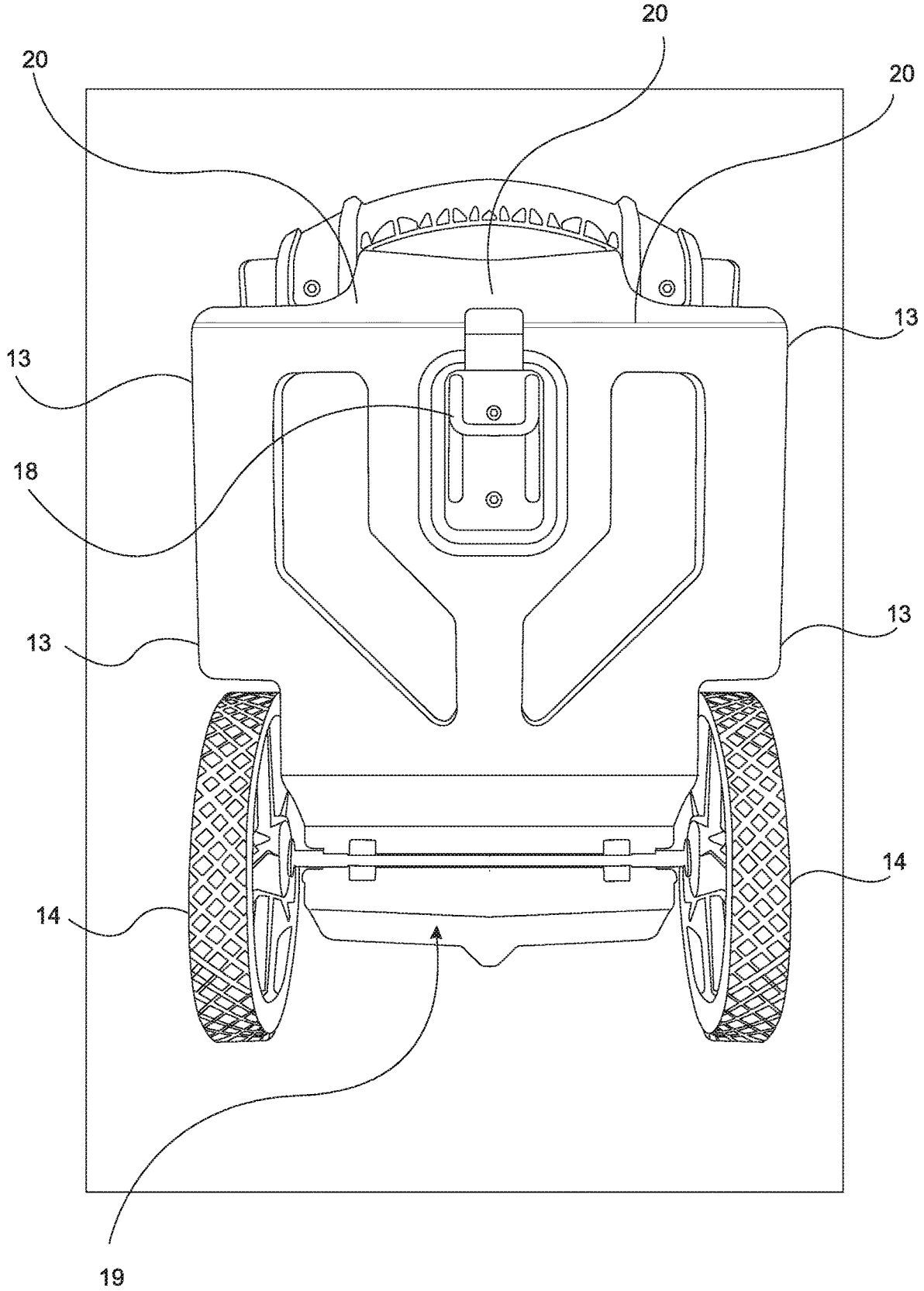
FIG. 5 shows details of the towing attachment.

FIG. 5 illustrates the back side of the fuel caddy, showing the off-road wheels 14, the handle molded 19 into the fuel caddy to facilitate lifting, the towing attachment 20, and the back hook 18, which mounts over a ladder leg. Also shown are the four handles 13, two on either side which facilitate lifting of the fuel caddy.

Figure 6:
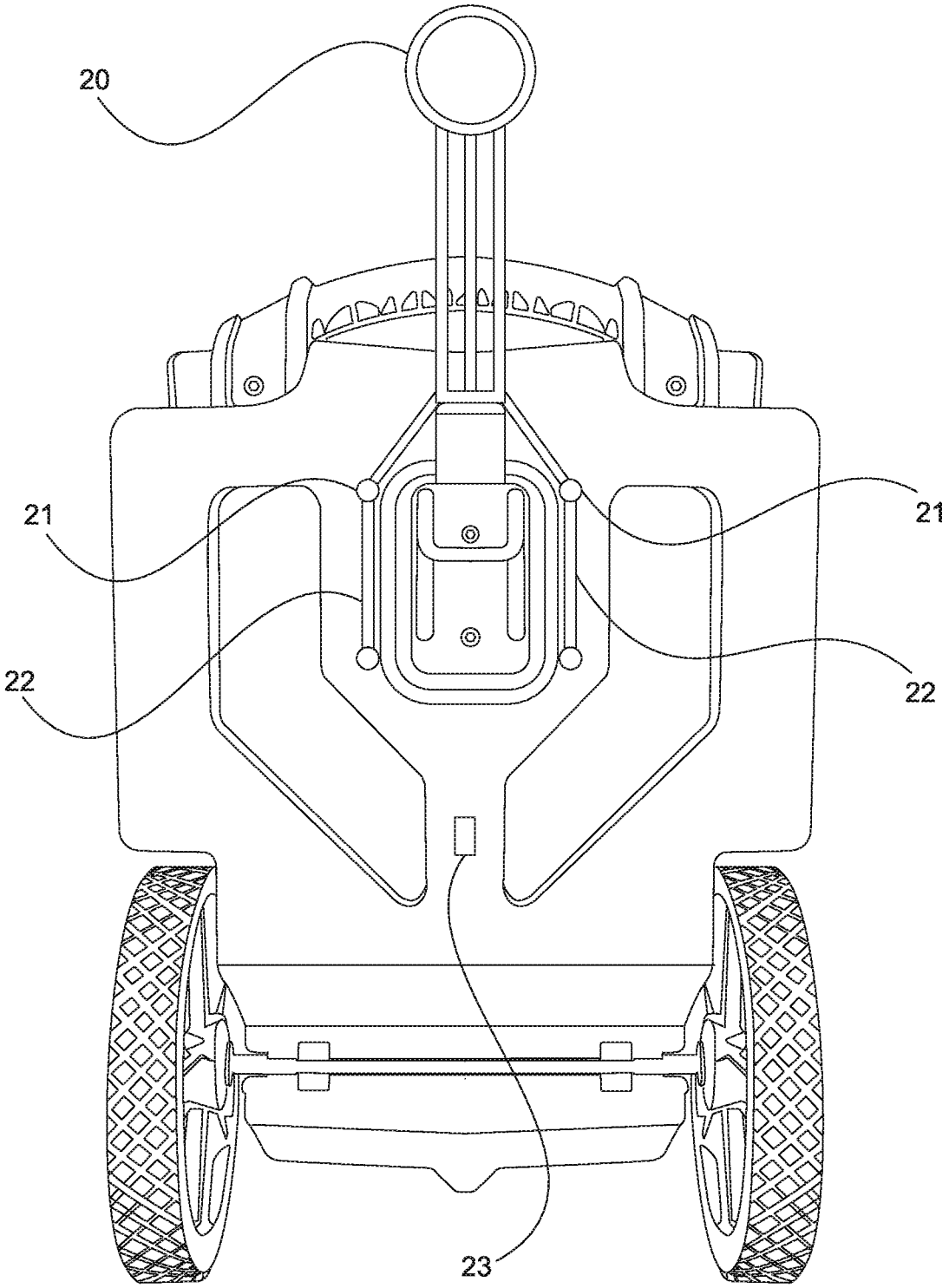
FIG. 6 shows the front side of the fuel caddy and is a view when the fuel caddy is in use, versus FIG. 2 which shows the front of the fuel caddy when it is not in use.

FIG. 6 illustrates the towing attachment 20 with its key components, the hinges 24, the support bars 25 and the quick snap holder for the towing attachment 26. When in use the towing attachment 20 is positioned as shown in the drawing, when not in use the towing attachment is swung down and locked in place with the quick snap holder. The fuel caddy is towed in the horizontal position.

Figure 7:
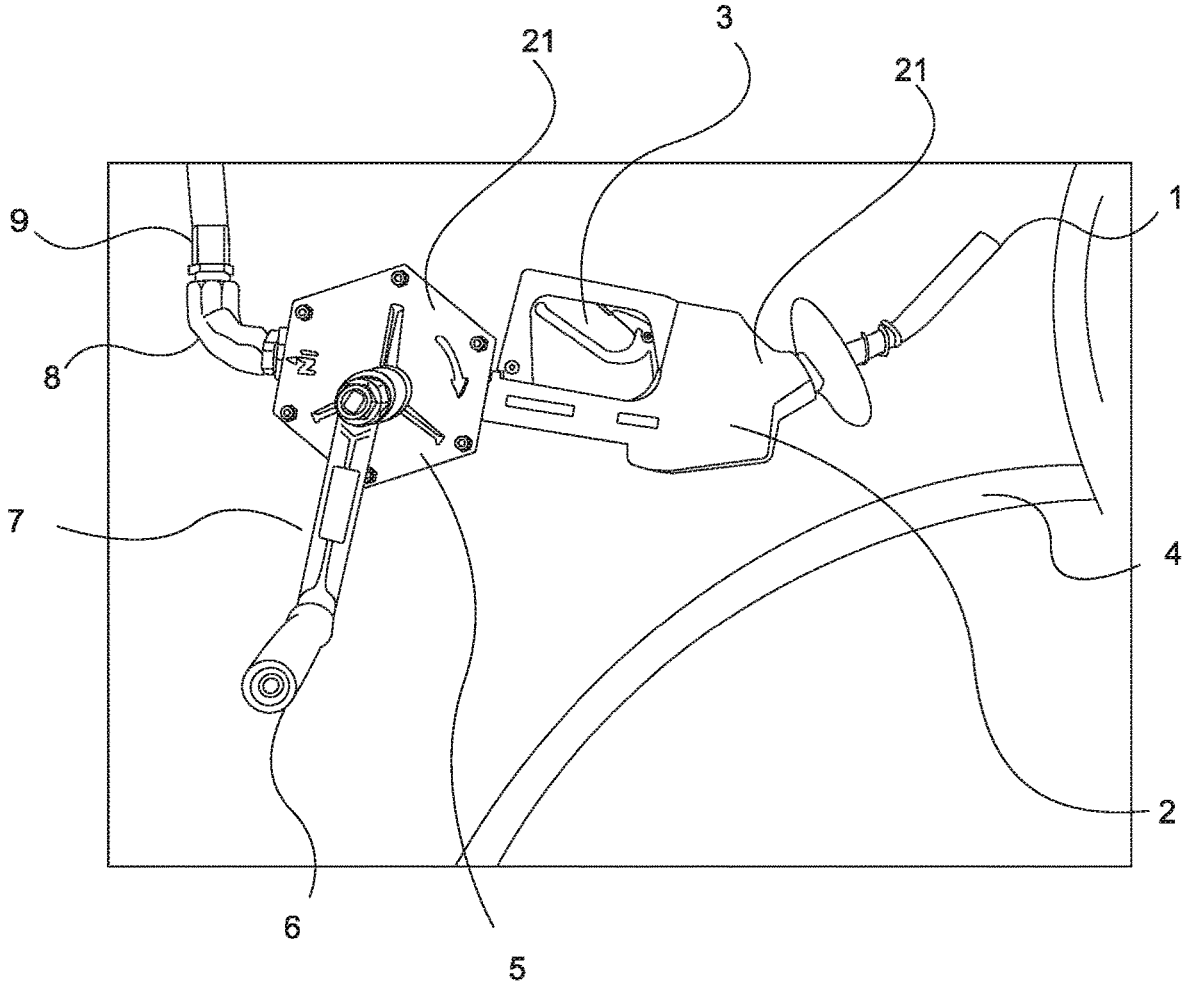
FIG. 7 shows the integrated rotary pump and the gas flow control mechanical device.

FIG. 7 illustrates the key feature of the preferred embodiment, with the rotary pump 5 with hand crank 7 an integral part with the gas flow control mechanism, both combined in one part 21.

Figure 8:
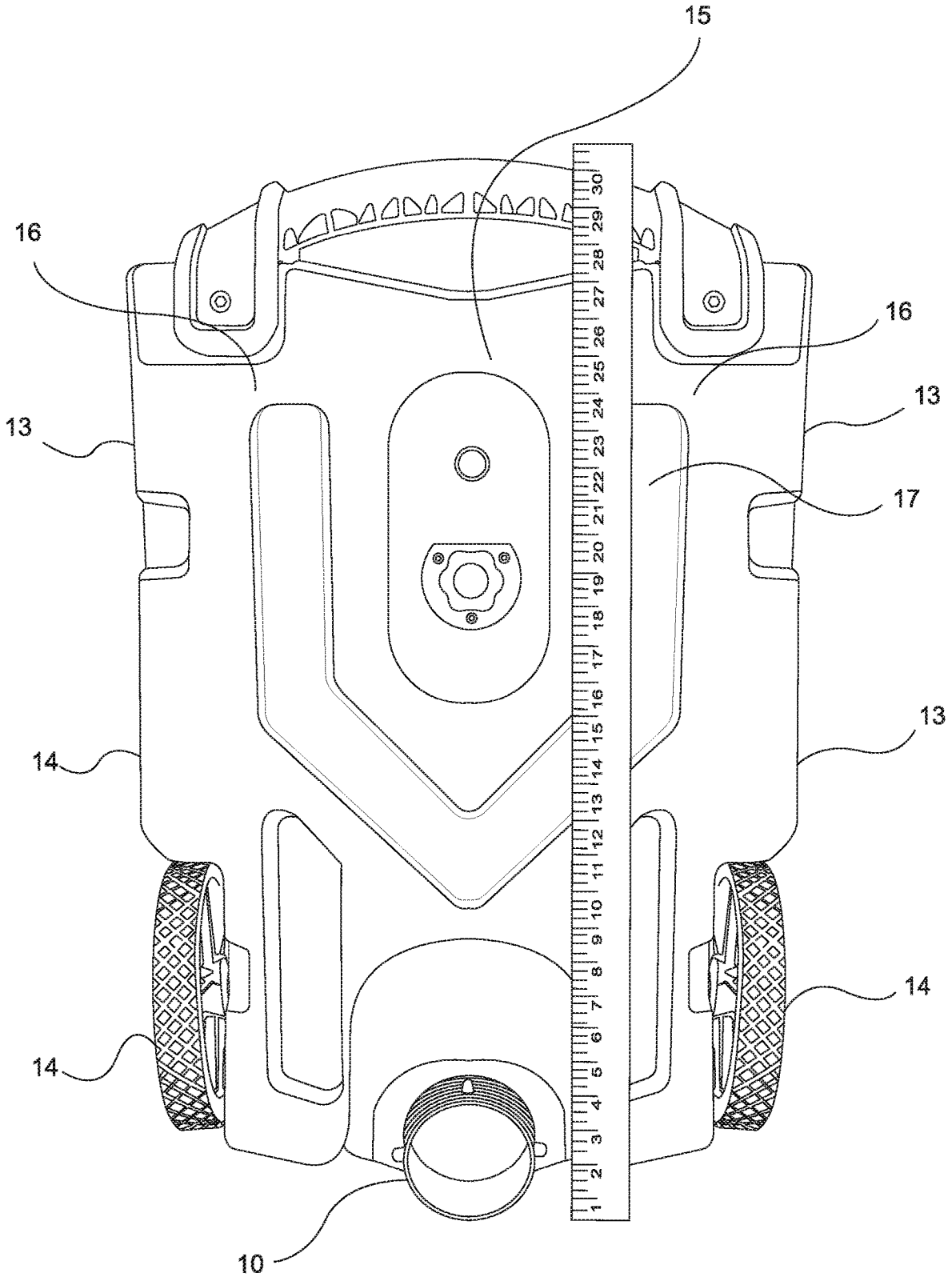
FIG. 8 shows the front side of the fuel caddy and is a view when the fuel caddy is in use, (though the figure does not show the gas hose being connected) versus FIG. 2 which shows the front of the fuel caddy when it is not in use.

FIG. 8 illustrates the front of the fuel caddy when the caddy is in use, with the gas hose 4 and gas flow control mechanism device at the fueling point. The second end of the gas hose 4 has a connector 11 which is attached to a swivel 12 and connected to the metal connection port on fuel caddy 10. The molded body of the fuel caddy has two handles 13 molded in, one higher than the other on each side of the fuel caddy, two hooks near the top of the fuel caddy 16 and a hook further down on the left side 17, are there to wind up the gas hose 4 when the fuel caddy is not use.

I claim:

1. A liquid fuel caddy that facilitates one-hand operation comprising:

a molded fuel caddy body;

a gas line exiting the a bottom of the liquid fuel caddy;

the gas line connected to an integrated part for dispensing containing a gas flow control mechanism and a rotary pump;

the integrated part having a fueling nozzle;

the integrated part having a gas flow control lever;

the integrated part having a hand crank for the rotary pump;

the gas line exits the rotary pump section of the integrated part and connects to a fuel compartment of the liquid gas caddy through a connection;

the gas line extends from the rotary pump of the integrated part to a second connection on the bottom of the molded liquid fuel caddy and;

the molded fuel caddy body contains hooks to facilitate wrapping the gas line when the liquid per fuel caddy is not in use.

2. The liquid fuel caddy of claim 1 wherein an integrated gas flow control mechanical fitting and a rotary drum pump are two separate components connected by a male connecting fitting on the gas flow control mechanic fitting and a female connecting device on the rotary pump.

3. A hand crank of the liquid fuel caddy of claim 1 wherein the hand crank folds over the rotary pump for storage.

* * * * *